US012601106B2

(12) United States Patent
Yamashita

(10) Patent No.: US 12,601,106 B2
(45) Date of Patent: Apr. 14, 2026

(54) WIPING SHEET AND METHOD FOR MANUFACTURING WIPING SHEET

(71) Applicant: DAIO PAPER CORPORATION, Shikokuchuo (JP)

(72) Inventor: Shoko Yamashita, Shikokuchuo (JP)

(73) Assignee: DAIO PAPER CORPORATION, Shikokuchuo (JP)

( * ) Notice: Subject to any disclaimer, the term of this patent is extended or adjusted under 35 U.S.C. 154(b) by 1082 days.

(21) Appl. No.: 17/621,384

(22) PCT Filed: Jul. 9, 2020

(86) PCT No.: PCT/JP2020/026852
§ 371 (c)(1),
(2) Date: Sep. 2, 2022

(87) PCT Pub. No.: WO2021/010278
PCT Pub. Date: Jan. 21, 2021

(65) Prior Publication Data

US 2022/0403590 A1 Dec. 22, 2022

(30) Foreign Application Priority Data

Jul. 18, 2019 (JP) ..... 2019-132461

(51) Int. Cl.
*A47L 13/16* (2006.01)
*A47K 7/02* (2006.01)
(Continued)

(52) U.S. Cl.
CPC ..... *D06N 3/0011* (2013.01); *A47K 7/02* (2013.01); *A47L 13/16* (2013.01); *D06N 3/0088* (2013.01);
(Continued)

(58) Field of Classification Search
CPC ..... A47L 13/16; A47K 7/02; B32B 5/02
See application file for complete search history.

(56) References Cited

U.S. PATENT DOCUMENTS 6,695,992 B2 * 2/2004 Reneker ..... D04H 3/02 425/382.2
2004/0092185 A1 * 5/2004 Grafe ..... D04H 1/4374 442/64

(Continued)

FOREIGN PATENT DOCUMENTS

JP 2003103677 A 4/2003
JP 2010200860 A 9/2010

(Continued)

OTHER PUBLICATIONS

Extended European Search Report issued on Jul. 14, 2022, in connection with corresponding European Application No. 20840394.9; 5 pages.

(Continued)

*Primary Examiner* — Michael D Jennings
(74) *Attorney, Agent, or Firm* — Maier & Maier, PLLC

(57) ABSTRACT

A wiping sheet includes a patterned part of a fiber assembling base material and a non-patterned part of the fiber
(Continued)

assembling base material. The patterned part includes cellulose nanofiber; and the non-patterned part does not include the cellulose nanofiber.

8 Claims, 2 Drawing Sheets

(51) Int. Cl.

| | |
|---|---|
| ***D06N 3/00*** | (2006.01) |
| ***D06N 3/12*** | (2006.01) |
| ***D21F 11/00*** | (2006.01) |
| ***D21H 11/18*** | (2006.01) |
| ***D21H 27/00*** | (2006.01) |
| ***D21H 27/02*** | (2006.01) |

(52) U.S. Cl.
CPC ..... *D06N 3/12* (2013.01); *D21F 11/006* (2013.01); *D21H 11/18* (2013.01); *D21H 27/002* (2013.01); *D21H 27/02* (2013.01); *D06N 2201/02* (2013.01); *D06N 2201/042* (2013.01); *D06N 2203/026* (2013.01); *D06N 2205/16* (2013.01); *D06N 2211/08* (2013.01)

(56) References Cited

U.S. PATENT DOCUMENTS

| | | | | |
|---|---|---|---|---|
| 2006/0094320 | A1* | 5/2006 | Chen | D04H 1/42 428/218 |
| 2011/0031431 | A1* | 2/2011 | Hull | H01F 7/0221 252/62.51 R |
| 2016/0113340 | A1* | 4/2016 | Levit | B32B 27/00 2/455 |
| 2016/0215179 | A1* | 7/2016 | Sumnicht | C09J 129/04 |
| 2019/0167061 | A1* | 6/2019 | Calimano | B32B 5/022 |

FOREIGN PATENT DOCUMENTS

| | | | | |
|---|---|---|---|---|
| JP | 4605971 | B2 | 1/2011 | |
| JP | 201476653 | A | 5/2014 | |
| JP | 201835469 | A | 3/2018 | |
| JP | 2018514369 | A | 6/2018 | |
| WO | 0154640 | A1 | 8/2001 | |
| WO | WO-2006108363 | A2 * | 10/2006 | B32B 5/02 |
| WO | WO-2018101336 | A1 * | 6/2018 | A61K 8/02 |

OTHER PUBLICATIONS

International Preliminary Report on Patentability with English translation issued on Jan. 18, 2022, in corresponding International Application No. PCT/JP2020/026852; 9 pages.

Office Action issued on Oct. 19, 2021, in connection with corresponding Japanese Application No. 2019-132461 (5 pp., including machine-generated English translation).

International Search Report (with English translation) and Written Opinion (with Machine translation) issued on Sep. 1, 2020 in corresponding International Patent Application No. PCT/JP2020/026852; 10 pages.

Office Action issued on Jun. 17, 2025, in corresponding Korean Application No. 10-2021-7041872, 9 pages.

* cited by examiner

WIPING SHEET AND METHOD FOR MANUFACTURING WIPING SHEET

TECHNICAL FIELD

The present invention relates to a wiping sheet and a method for manufacturing the wiping sheet.

BACKGROUND

There are several methods of forming patterned parts in a nonwoven fabric, which is a material for wiping sheets, such as forming the patterned parts when web fibers are joined by a spunlace method, or by heat embossing process of plain nonwoven fabrics (see patent document 1).

[Patent Document 1] JP 2010-200860 A

SUMMARY

However, in the spun lace method, it is difficult to form unevenness in the nonwoven fabric by forming the patterned parts. Also, the heat embossing process requires large scaled equipment. Therefore, it has been desired to easily form unevenness on nonwoven fabrics by forming the patterned parts.

An object of the present invention is to provide a wiping sheet that enables easy formation of unevenness on nonwoven fabrics by forming a patterned part, and a method for manufacturing the wiping sheet.

In order to achieve the object, according to the invention, there is provided a wiping sheet including:

- a patterned part of a nonwoven fabric, the patterned part including cellulose nanofiber; and
- a non-patterned part of the nonwoven fabric, the non-patterned part not including the cellulose nanofiber.

According to the invention, there is provided a wiping sheet wherein the patterned part has an area of 10 to 60% of a total area of the nonwoven fabric.

According to the invention, there is provided a wiping sheet wherein the patterned part is formed only on one surface of the nonwoven fabric.

According to the invention, there is provided a method for manufacturing a wiping sheet, including:

- applying a cellulose nanofiber solution of 0.75 to 2.00% to a nonwoven fabric according to a set pattern, thereby forming a patterned part; and
- thermal drying of the nonwoven fabric to which the cellulose nanofiber solution has been applied.

According to the invention, there is provided a method for manufacturing a wiping sheet, wherein, in the applying, the cellulose nanofiber solution is applied to an area of 10 to 60% of a total area of the nonwoven fabric.

According to the invention recited, there is provided a method for manufacturing a wiping sheet according to claim 4, wherein, in the applying, the cellulose nanofiber solution is applied using a spray.

According to the present invention, there is provided a wiping sheet that enables easy formation of unevenness on nonwoven fabrics by forming a patterned part, and a method for manufacturing the wiping sheet.

DETAILED DESCRIPTION OF

[Wiping Sheet]

A wiping sheet P of the present invention is prepared by applying a solution including various ingredients added to purified water to one surface of a fiber assembling base material in a shape of a sheet such as a nonwoven fabric, for example, and then by thermal drying.

Figure 1:
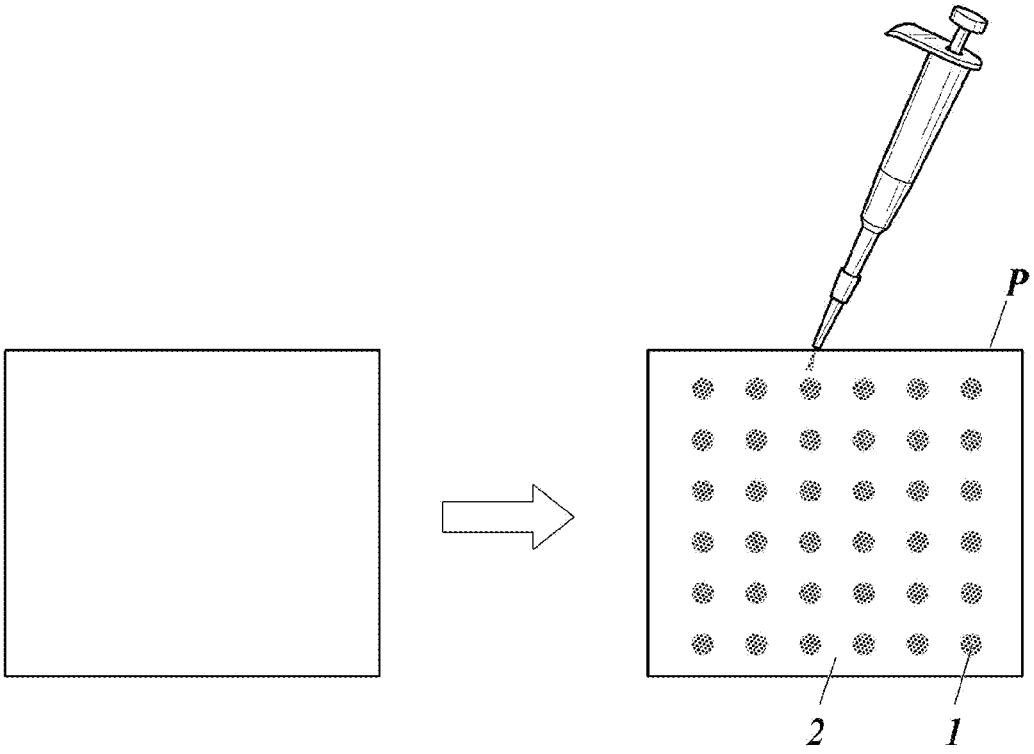
FIG. 1 is a diagram showing an example of a method of forming a patterned part on a nonwoven fabric according to an embodiment.

As shown in FIG. 1, for example, the wiping sheet P has a patterned part(s) 1 formed in a shape of a lattice point(s) on the entire surface, and a non-patterned part(s) 2, which is the part(s) other than the patterned part(s) 1.

The patterned part 1 contains cellulose nanofiber (hereafter referred to as CNF) and has a higher fiber density than the non-patterned part 2 due to heat shrinkage.

The non-patterned part 2 does not contain CNF and has a lower fiber density than the patterned part 1.

The patterned part 1 and the non-patterned part 2 forms unevenness in the wiping sheet P as a result of depression of the patterned part 1 due to heat shrinkage. More specifically, when a part where CNF is applied is heated, water in a CNF solution evaporates such that the hydrogen bond between CNF becomes stronger, and fibers of the nonwoven fabric in the part where CNF is applied are condensed (shrinked), and resulting in a height difference from the non-patterned part 2. On the other hand, since carboxymethyl cellulose (hereinafter referred to as "CMC"), for example, does not have as many hydrogen bonds as CNF, even when CMC is applied to a nonwoven fabric and the part is heated, the fibers of the nonwoven fabric are not condensed (shrinked) and are unlikely to form the height difference from the non-patterned part 2.

The pattern part 1 may have any designs, arrangement, and orientation, and may be any pattern as long as it can be formed by application.

Figure 2A:
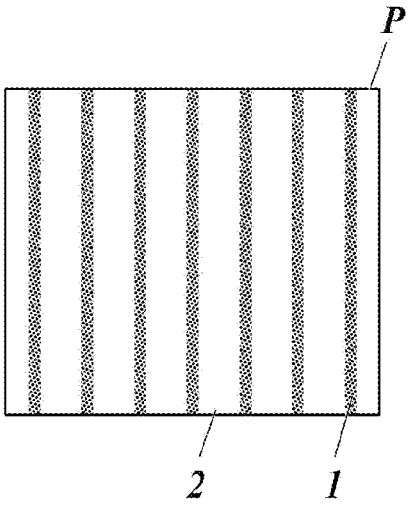
FIG. 2A is a diagram of an example of a patterned part of a nonwoven fabric according to an embodiment.
Figure 2B:
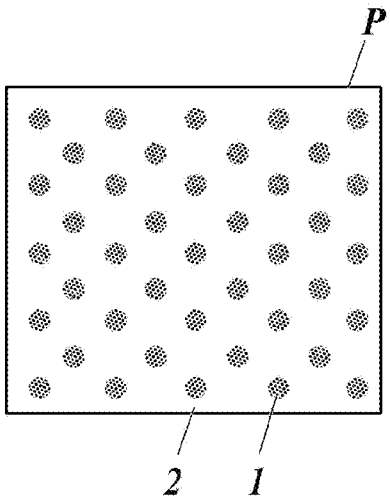
FIG. 2B is a diagram of an example of a patterned part of a nonwoven fabric according to an embodiment.
Figure 2C:
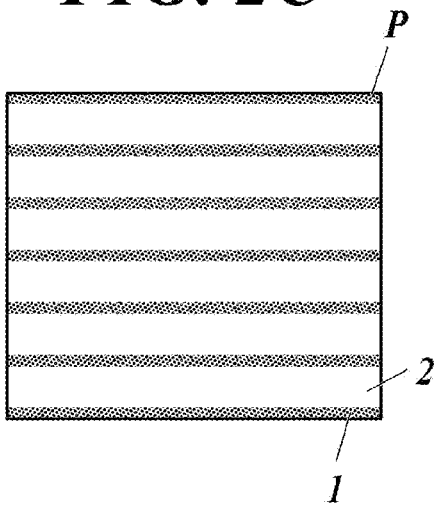
FIG. 2C is a diagram of an example of a patterned part of a nonwoven fabric according to an embodiment.
Figure 2D:
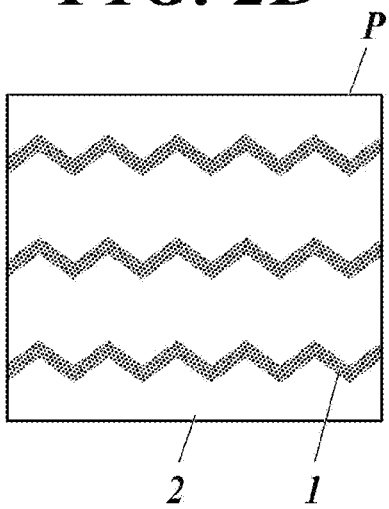
FIG. 2D is a diagram of an example of a patterned part of a nonwoven fabric according to an embodiment.
Figure 2E:
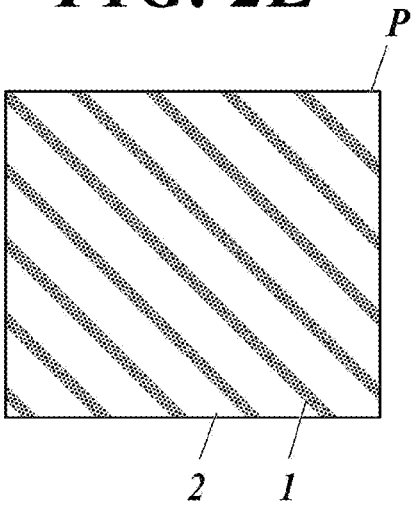
FIG. 2E is a diagram of an example of a patterned part of a nonwoven fabric according to an embodiment.

For example, as shown in FIG. 2A, the wiping sheet P may be shaped so as to have patterned parts 1 that are formed as perpendicular lines in a vertical direction and non-patterned parts 2 that are parts other than the patterned parts 1. Alternatively, the patterned parts 1 may be in the form of diagonal lattice points as shown in FIG. 2B, or may be in the form of perpendicular lines in a horizontal direction as shown in FIG. 2C. Alternatively, the patterned parts 1 may be in the form of triangle waves as shown in FIG. 2D, or may be in the form of diagonal lines as shown in FIG. 2E.

At this time, in order that the entire wiping sheet P has a suitable unevenness, it is preferable to apply the CNF solution such that an area of the patterned part(s) 1 is 10 to 60% of the total area of the nonwoven fabric. This is because, when the area of the patterned part(s) 1 is smaller than 10%, it has little unevenness and does not exhibit wiping or scraping properties. When the area of the patterned part (s) 1 is larger than 60%, the patterned part(s) 1 is so large that softness is impaired.

The wiping sheets P as a product is formed into a stack of a plurality of sheets so as to be stored in a packaging means that has a sheet outlet and can be sealed by an open/close lid, such as a sealed container or a bag.

For use, a user opens the outlet and pulls out a sheet in the container or bag directly containing the wiping sheets P, or in a container containing a bag directly containing the wiping sheets P.

Such wiping sheets P can be used for a variety of purposes, for example, as body wiping sheets, cleaning sheets for floors, and the like.

[Fiber Assembling Base Material]

The fiber assembling base material may be a nonwoven fabric made of predetermined fiber as a fiber material. The nonwoven fabric is manufactured by using a well-known technology such as spunlace, air through, air laid, point bond, spun bond, needle punch, or the like.

The predetermined fiber may be any natural, recycled, or synthetic fiber. The predetermined fiber is, for example, cellulose fiber such as rayon, lyocell, tencel, and cotton; polyolefin fiber such as polyethylene, polypropylene, and polyvinyl alcohol; polyester fiber such as polyethylene terephthalate and polybutylene terephthalate; and polyamide fiber such as nylon. These can be used alone or in combination of two or more kinds of these.

In the present invention, hydrophilic fiber is preferably contained at least. This is because a nonwoven fabric containing hydrophilic fiber is more effective in wiping off dirt than a nonwoven fabric that does not contain hydrophilic fiber.

(Hydrophilic Fiber)

Hydrophilic fiber may be natural fiber such as cotton and pulp, and recycled fiber such as rayon and cupra. Among these kinds of fiber, rayon is particularly preferred. Rayon is highly water-absorbent and easy to handle, and fibers of a certain length can be obtained at a low cost. Such hydrophilic fiber are preferably blended in the base material at a content ratio of 40 to 70% by mass. When the hydrophilic fiber is contained at a content of less than 40% by mass, sufficient flexibility or water retention cannot be exhibited. When the hydrophilic fiber is contained at a content of more than 70% by mass, the sheet has too small wet strength and is easy to be torn, so as to be stretched too much when taken out from the container by a pop-up method.

(Basis Weight)

A basis weight of the wiping sheet P of the present invention is preferably 20 to 80 g/m$^2$, and particularly preferably 30 to 60 g/m$^2$. When the basis weight of the sheet is less than 20 g/m$^2$, the ability of the sheet to retain dirt becomes poor, and when the basis weight of the sheet exceeds 80 g/m$^2$, the softness of the sheet becomes poor.

[CNF]

CNF is a material having a moisture retaining property, highly safe, and made of fine cellulose fibers obtained by fibrillation of pulp fiber. Generally, cellulose fiber containing cellulose fine fibers having a fiber width of nano-scale (1 nm or more and 1000 nm or less) are referred to as CNF, and an average fiber width of the fine fibers is preferably less than 100 nm. The average fiber width is calculated from a certain number of fibers by using, for example, a number average, a median, or a mode diameter (the most frequent value).

(Pulp Fiber Used for CNF)

Examples of pulp fiber that can be used as CNF include: chemical pulp such as hardwood pulp (LBKP) and conifer pulp (NBKP); mechanical pulp such as bleached thermo-mechanical pulp (BTMP), stone ground pulp (SGP), pressurized stone ground pulp (PGW), refiner ground pulp (RGP), chemi-ground pulp (CGP), thermo-ground pulp (TGP), ground pulp (GP), thermo-mechanical pulp (TMP), chemi-thermo-mechanical pulp (CTMP), refiner mechanical pulp (RMP); used paper pulp made from used brown paper, used craft envelope paper, used magazine paper, used newsprint paper, used leaflet paper, used office paper, used corrugated paper, used woodfree paper, used Kent paper, used simili paper, used grey cardboard paper, used coarse paper, and the like; and deinked pulp (DIP) made by deinking used paper pulp. These may be used alone or in combination or two or more, as long as the effects of the invention are not impaired.

(Fibrillation Method)

The fibrillation methods used in manufacturing the CNF may be, but are not limited to, a mechanical method such as high-pressure homogenizer, microfluidizer, grinder grinding, bead mill freezing and pulverizing, and ultrasonic fibrillation.

CNF that has been only mechanically treated by the above fibrillation methods (in other words, CNF that has not been modified), namely, CNF that has been subjected to no modification with functional groups, has higher thermal stability and therefore can be used in a wider range of applications than CNF that has been subjected to modification with functional groups such as phosphate groups and carboxymethyl groups. However, CNF that has been subjected to modification with functional groups such as phosphate groups and carboxymethyl groups can also be used in the present invention.

Alternatively, for example, the pulp fiber may be mechanically treated by the fibrillation methods, and then chemically treated by carboxymethylation, or enzymatically treated. Chemically treated CNF include, for example, iCNF (individualized CNF) (single nanocellulose) having a diameter of 3 to 4 nm, such as TEMPO-oxidized CNF, phosphorylated CNF, and phosphite esterified CNF.

Alternatively, CNF treated only chemically or enzymatically, or CNF treated chemically or enzymatically and then treated mechanically by the fibrillation method may also be used.

[CMC]

In order to prevent CNF from aggregating in the solution, CMC, which is a water-soluble polymer, may be added to the solution.

When CNF is added to an aqueous solvent, microfibril fibers of the CNF bind to each other and aggregate. However, when CMC is added thereto so that CNF and CMC exist together, OH groups of the CNF and OH groups of the CMC form hydrogen bonds, and the electrostatic interaction of the molecular chains and the steric hindrance effect prevent CNF from aggregating. As a result, CNF can be uniformly dispersed in the solution.

CMC is preferably used because it is obtained from cellulose as a raw material, has moderate biodegradability, and can be incinerated after use, thus being an extremely environmentally friendly material. However, water-soluble polymers other than CMC may be used as long as they can prevent CNF from aggregating in the solution.

CMC is preferably added such that the solution contains 93.000 to 99.790% by mass of water, 0.002 to 0.020% by mass of CNF, and 0.100 to 1.000% by mass of CMC, when the entire solution is 100.000% by mass.

The solution can be impregnated in the range of 100 to 500% by mass relative to the dry weight of the fiber assembling base material, but preferably in the range of 200 to 350% by mass.

EXAMPLES

Figure 3:
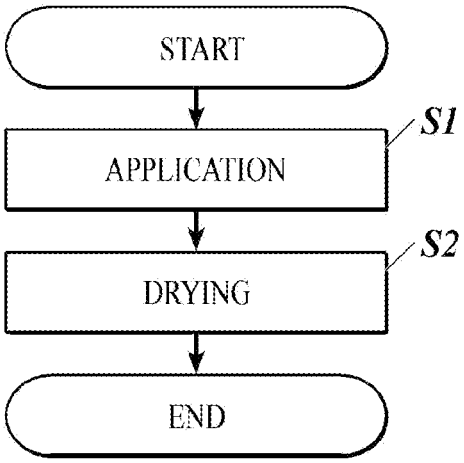
FIG. 3 is a flowchart of a method for manufacturing a wiping sheet according to an embodiment.

Hereinafter, the present invention is described in detail referring to examples and a flowchart of a manufacturing method of the wiping sheet P shown in FIG. 3, but the present invention is not limited to these.

[Preparation of Sample]

First, nonwoven fabrics (fiber blend; rayon:PET=50:50) of 11 cm by 11 cm having a basis weight of 70 g/$m^2$ in a dry state were prepared. The dry state means that the sheet is not impregnated with any liquid such as a pharmaceutical liquid.

Next, solutions were applied to only one surface of the above nonwoven fabrics under respective conditions of Examples 1 to 13 and Comparative Examples 1 to 10 (Step S1).

Next, the nonwoven fabrics were left in a 60° C. thermostatic bath for one day for thermal drying (Step S2), and the wiping sheets P were prepared.

The conditions of Examples 1 to 13 and Comparative Examples 1 to 10 are as follows.

Examples 1 to 4

Mechanically treated CNF solutions with respective concentrations of 0.75%, 1.00%, 1.50%, and 2.00% were applied using a micropipette (Nichipet EXII00-NPX2-1000) in the form of dots each having a diameter of 2 to 3 mm and separated from each other by 10 to 15 mm as shown in FIG. 1. The CNF solution of 0.75%, for example, is a solution in which [water as solvent]: CNF=99.25%: 0.75%.

Examples 5 to 8

Enzymatically treated CNF solutions with respective concentrations of 0.75%, 1.00%, 1.50%, and 2.00% were applied.

The other conditions were the same as those in Example 1.

Examples 9 to 11

TEMPO-oxidized CNF solutions with respective concentrations of 0.75%, 1.00%, and 1.50% were applied.

The other conditions were the same as those in Example 1.

Examples 12 to 13

ELLEX-☆ (star) solutions (phosphite esterified CNF dispersed in water) with respective concentrations of 0.75% and 1.00% were applied.

The other conditions were the same as those in Example 1.

Comparative Example 1

A mechanically treated CNF solution with a concentration of 0.50% was applied.

The other conditions were the same as those in Example 1.

Comparative Example 2

An enzymatically treated CNF solution with a concentration of 0.50% was applied.

The other conditions were the same as those in Example 1.

Comparative Example 3

A TEMPO-oxidized CNF solution with a concentration of 0.50% was applied.

The other conditions were the same as those in Example 1.

Comparative Example 4

An ELLEX-☆ (star) solution with a concentration of 0.50% was applied.

The other conditions were the same as those in Example 1.

Comparative Examples 5 to 9

CMC solutions with respective concentrations of 0.50%, 0.75%, 1.00%, 1.50%, and 2.00% were applied.

The other conditions were the same as those in Example 1.

Comparative Example 4

Purified water was applied.

The other conditions were the same as those in Example 1.

Using the above sheets of Examples and Comparative Examples, the following Tests 1 to 5 were conducted.

[Test 1. Examination of Concentration of Mechanically Treated CNF Solution, Presence of Unevenness, and Softness of Nonwoven Fabric]

The following two tests were conducted for the samples of Examples 1 to 4 and Comparative Example 1.

[Evaluation Method]

(Sensory Evaluation of Unevenness)

The samples of Examples and Comparative Example were compared by ten testers, and the presence or absence of unevenness was evaluated.

The test result was set as AA when seven or more out of the ten testers answered that the sheet was uneven, as CC when seven or more out of the ten testers answered that the sheet was not uneven, and as BB in the other cases.

(Sensory Evaluation of Softness)

The samples of the Examples and the Comparative Example were compared by ten testers, and the softness was evaluated.

The test result was set as AA when seven or more out of the ten testers answered that the sheet was as soft as or softer than a nonwoven fabric without CNF application, as CC when seven or more out of the ten testers answered that the sheet was harder than a nonwoven fabric without CNF application, and as BB in the other cases.

Results of the tests are shown in Table I.

TABLE I

| | COMPARATIVE EXAMPLE 1 MECHANICALLY TREATED CNF 0.50% | EXAMPLE 1 MECHANICALLY TREATED CNF 0.75% | EXAMPLE 2 MECHANICALLY TREATED CNF 1.00% | EXAMPLE 3 MECHANICALLY TREATED CNF 1.50% | EXAMPLE 4 MECHANICALLY TREATED CNF 2.00% |
|---|---|---|---|---|---|
| PRESENCE OF UNEVENNESS | CC | AA | AA | AA | AA |
| SOFTNESS | — | AA | AA | AA | BB |

[Evaluation]

Comparison of each of Examples 1 to 4 and Comparative Example 1 in Table I revealed that both unevenness formation and softness of the sheet P could be achieved as a result of applying the mechanically treated CNF solution with a concentration of 0.75 to 2.00%, more preferably 0.75 to 1.50%.

[Test 2. Examination of Concentration of Enzymatically Treated CNF Solution, Presence of Unevenness, and Softness of Nonwoven Fabric]

Next, tests similar to Test 1 were conducted for the samples of Examples 5 to 8 and Comparative Example 2. The results of the tests are shown in Table II.

TABLE II

| | COMPARATIVE EXAMPLE 2 ENZYMATICALLY TREATED CNF 0.50% | EXAMPLE 5 ENZYMATICALLY TREATED CNF 0.75% | EXAMPLE 6 ENZYMATICALLY TREATED CNF 1.00% | EXAMPLE 7 ENZYMATICALLY TREATED CNF 1.50% | EXAMPLE 8 ENZYMATICALLY TREATED CNF 2.00% |
|---|---|---|---|---|---|
| PRESENCE OF UNEVENNESS | CC | BB | AA | AA | AA |
| SOFTNESS | — | AA | AA | AA | BB |

[Evaluation]

Comparison of each of Examples 5 to 8 and Comparative Example 2 in Table II revealed that both unevenness formation and softness of the sheet P could be also achieved as a result of applying the enzymatically treated CNF solution with a concentration of 0.75 to 2.00%, more preferably 1.00 to 1.50%.

[Test 3. Examination of Concentration of TEMPO-Oxidized CNF Solution, Presence of Unevenness, and Softness of Nonwoven Fabric]

Next, tests similar to Test 1 were conducted for the samples of Examples 9 to 11 and Comparative Example 3. The results of the tests are shown in Table III.

TABLE III

| | COMPARATIVE EXAMPLE 3 TEMPO-oxidized CNF 0.50% | EXAMPLE 9 TTEMPO-oxidized CNF 0.75% | EXAMPLE 10 TEMPO-oxidized CNF 1.00% | EXAMPLE 11 TEMPO-oxidized CNF 1.50% |
|---|---|---|---|---|
| PRESENCE OF UNEVENNESS | CC | BB | BB | AA |
| SOFTNESS | AA | AA | AA | AA |

[Evaluation]

Comparison of each of Examples 9 to 11 and Comparative Example 3 in Table III revealed that both unevenness formation and softness of the sheet P could be also achieved as a result of applying the TEMPO-oxidized CNF solution with a concentration of 0.75 to 1.50%, more preferably 1.50%.

[Test 4. Examination of Concentration of ELLEX-☆ (Star) Solution, Presence of Unevenness, and Softness of Nonwoven Fabric]

Next, tests similar to Test 1 were conducted for the samples of Examples 12 to 13 and Comparative Example 4. The results of the tests are shown in Table IV.

TABLE IV

| | COMPARATIVE EXAMPLE 4 ELLEX-☆ 0.50% | EXAMPLE 12 ELLEX-☆ 0.75% | EXAMPLE 13 ELLEX-☆ 1.00% |
|---|---|---|---|
| PRESENCE OF UNEVENNESS | BB | AA | AA |
| SOFTNESS | BB | AA | AA |

[Evaluation]

Comparison of each of Examples 12 to 13 and Comparative Example 4 in Table IV revealed that both unevenness formation and softness of the sheet P could be also achieved as a result of applying the ELLEX-☆ (star) solution with a concentration of 0.75 to 1.00%.

[Test 5. Examination of Presence of Unevenness in Response to Application of Liquid Including No CNF]

Next, tests similar to Test 1 were conducted for the samples of Comparative Examples 5 to 10. The results of the test are shown in Table V.

TABLE V

| | COMPARATIVE EXAMPLE 5 CMC 0.50% | COMPARATIVE EXAMPLE 6 CMC 0.75% | COMPARATIVE EXAMPLE 7 CMC 1.00% | COMPARATIVE EXAMPLE 8 CMC 1.50% | COMPARATIVE EXAMPLE 9 CMC 2.00% | COMPARATIVE EXAMPLE 10 Purified water |
|---|---|---|---|---|---|---|
| PRESENCE OF UNEVENNESS | CC | CC | CC | CC | CC | CC |
| SOFTNESS | — | — | — | — | — | REFERENCE VALUE |

[Evaluation]

Comparative Examples 5 to 10 in Table V revealed that unevenness was not formed even after thermal drying when a liquid including no CNF was applied.

As can be seen from Tests 1 to 5 above, according to the present embodiment, by applying a CNF solution with a concentration of 0.75 to 2.00%, preferably 0.75 to 1.50%, to the nonwoven fabric and then by thermal drying, the formation of unevenness and softness can be achieved.

Also, from Tests 1 to 4, the CNF contained in the solution to be applied can be fibrillated by any method.

Effect of Embodiment

In the manufacturing processes of the wiping sheet P, unevenness by the patterned parts can be easily formed by applying the solution containing CNF to the nonwoven fabric with no pattern and then by thermal drying.

In addition, the patterned part 1 is formed on only one surface of the nonwoven fabric. As a result, after wiping off the dirt using the surface to which the CNF solution is applied so as to provide thickness feeling and to increase a contacting area, it is possible to perform wiping as a finish using a smooth and soft surface to which the CNF solution is not applied. This means that one wiping sheet P can realize two effects.

Although the present invention has been described in detail based on the above embodiments, the present invention is not limited to the above embodiments but can be modified as long as it does not depart from the gist of the present invention.

For example, in the above embodiments, the wiping sheet P is described as being used for cleaning, but is not limited to be used in this way. In addition, depending on the usage, components to be added to the solution and the pattern of application are of course changed.

The nonwoven fabric in the present invention is not particularly limited in its manufacturing method, composition, or basis weight. In addition, the unevenness formed in accordance with the above embodiment keeps its shape even in a wet state. Therefore, whether the sheet is dry or wet is also not limited according to the usage.

CNF is preferably applied to a nonwoven fabric using a spray from a viewpoint of uniform application. However, other methods are also applicable as long as they do not impair the effect of the present invention, such as droplet application using a dispenser; roll application where the solution is applied once to a roll and then the roll is brought into contact with the sheet surface for application of the solution; roll transfer using a flexographic or gravure printing machine.

The thermal drying method of a nonwoven fabric is preferably hot-air drying from the viewpoint of short time for the drying and low installation cost. However, other methods may be used alone or in combination as necessary, as long as the effects of the present invention are not impaired, for example, a method of drying the nonwoven fabric by directly contacting it on a surface of a heating roll such as a Yankee drum.

Although some embodiments of the present invention have been described, the scope of the present invention is not limited to the above mentioned embodiments, but includes the scope of the invention described in the claims and their equivalents.

INDUSTRIAL APPLICABILITY

The present invention is applicable to a wiping sheet and a manufacturing method of the wiping sheet, which can easily form unevenness on the nonwoven fabric with a patterned part.

REFERENCE SIGNS LIST

P Wiping sheet
1 Patterned part
2 Non-patterned part

The invention claimed is:

1. A wiping sheet comprising:

a sheet of fiber assembling base material comprising a layer of nonwoven fabric, the wiping sheet having a surface provided on an outside of the layer of nonwoven fabric, the surface extending over a length and a width of the wiping sheet and separated from an opposite surface of the wiping sheet by a thickness of the layer of nonwoven fabric;

a patterned part provided on a portion of the surface of the fiber assembling base material that is less than all of the surface, said patterned part comprising a repeating pattern including one of lines, waves, or shapes that is applied to the area of the surface, the patterned part including cellulose nanofiber; and a non-patterned part provided on a remainder of the surface of the fiber assembling base material on which the patterned part is provided, the non-patterned part not including the cellulose nanofiber.

2. The wiping sheet according to claim 1, wherein the patterned part has an area of 10 to 60% of a total area of the fiber assembling base material.

3. The wiping sheet according to claim 2, wherein the patterned part is formed only on one surface of the fiber assembling base material.

4. The wiping sheet according to claim 1, wherein the patterned part is formed only on one surface of the fiber assembling base material.

5. A method for manufacturing the wiping sheet of claim 1, comprising:

applying a cellulose nanofiber solution of 0.75 to 2.00% to a fiber assembling base material according to a set pattern, thereby forming a patterned part; and thermal drying of the fiber assembling base material to which the cellulose nanofiber solution has been applied.

6. The method for manufacturing a wiping sheet according to claim 5, wherein, in the applying, the cellulose nanofiber solution is applied to an area of 10 to 60% of a total area of the fiber assembling base material.

7. The method for manufacturing a wiping sheet according to claim 6, wherein, in the applying, the cellulose nanofiber solution is applied using a spray.

8. The method for manufacturing a wiping sheet according to claim 5, wherein, in the applying, the cellulose nanofiber solution is applied using a spray.

* * * * *